US012590451B2

(12) United States Patent
Schuler

(10) Patent No.: US 12,590,451 B2
(45) Date of Patent: Mar. 31, 2026

(54) LEDGER BOARD SYSTEM

(71) Applicant: Michael D. Schuler, Hamburg, NY (US)

(72) Inventor: Michael D. Schuler, Hamburg, NY (US)

( * ) Notice: Subject to any disclaimer, the term of this patent is extended or adjusted under 35 U.S.C. 154(b) by 273 days.

(21) Appl. No.: 18/482,545

(22) Filed: Oct. 6, 2023

(65) Prior Publication Data

US 2024/0191493 A1 Jun. 13, 2024

Related U.S. Application Data

(60) Provisional application No. 63/432,126, filed on Dec. 13, 2022.

(51) Int. Cl.
*E04B 1/00* (2006.01)

(52) U.S. Cl.
CPC ..... *E04B 1/003* (2013.01)

(58) Field of Classification Search
CPC ..... E04B 1/003
See application file for complete search history.

(56) References Cited

U.S. PATENT DOCUMENTS 4,660,799 A * 4/1987 Butland ..... A61B 6/4405 248/676
5,483,773 A * 1/1996 Parisien ..... E04B 1/003 52/656.1
5,857,306 A * 1/1999 Pellock ..... E04B 1/5806 403/231
5,956,916 A * 9/1999 Liss ..... E04B 5/14 52/480
8,739,489 B2 * 6/2014 Weber ..... E04F 11/1846 52/510
2019/0218766 A1 * 7/2019 Winter ..... E04B 1/003
2024/0026675 A1 * 1/2024 Weber ..... E04B 5/14

FOREIGN PATENT DOCUMENTS

DE 19921837 A1 * 9/2000 ..... E04D 13/0445
DE 20119939 U1 * 5/2002 ..... E04B 1/003
EP 2899411 A1 * 7/2015 ..... E04F 15/02183

* cited by examiner

*Primary Examiner* — Theodore V Adamos
(74) *Attorney, Agent, or Firm* — Hodgson Russ LLP

(57) ABSTRACT

A ledger board for use in constructing a structural extension on an existing structure has a monolithic body that extends along a longitudinal axis and is attachable to one or more structural members of the existing structure. The monolithic body includes an inner attachment surface for engaging the existing structure and has a cross-sectional configuration defining an upper flashing portion having an outer surface, an upwardly open gutter conduit extending along the longitudinal axis below the flashing portion, an upwardly facing support surface extending along the longitudinal axis above the gutter conduit, an outwardly facing mounting surface extending along the longitudinal axis below the support surface, at least one fastener channel that extends along the longitudinal axis below the support surface and is open through the mounting surface, and a downwardly open siding groove extending along the longitudinal axis.

4 Claims, 5 Drawing Sheets

LEDGER BOARD SYSTEM

CROSS-REFERENCE TO RELATED APPLICATION

The present application claims priority and benefit of U.S. Provisional Patent Application No. 63/432,126 filed Dec. 13, 2022, the entire disclosure of which is incorporated herein by reference.

FIELD OF THE DISCLOSURE

The present disclosure relates to ledger boards used for attaching decks, stairs, or other structural extensions to a home or other existing structure.

BACKGROUND OF THE DISCLOSURE

It is known to attach decks to an existing home structure by way of a "ledger board." Typically, the ledger board is fastened by screws to a structural member of the home, and flashing and siding are installed around the ledger board. Decks often fail at the location of attachment because water penetrates to the ledger board and the ledger board gradually rots until it is unable to support the load. Deck failures may result in costly repairs, injuries, and even deaths.

BRIEF SUMMARY OF THE DISCLOSURE

An object of the present disclosure is to provide a fail-proof system for attachment of decks, stairs, or other structural extensions to a home or other building that protects the home or building and the people in it.

In furtherance of this object and others, a ledger board for use in constructing a structural extension on an existing structure is disclosed. In one embodiment, the ledger board has a monolithic body that extends along a longitudinal axis and is attachable to one or more structural members of the existing structure. The monolithic body includes an inner attachment surface for engaging the existing structure and has a cross-sectional configuration defining an upper flashing portion having an outer surface, an upwardly open gutter conduit extending along the longitudinal axis below the flashing portion, an upwardly facing support surface extending along the longitudinal axis above the gutter conduit, an outwardly facing mounting surface extending along the longitudinal axis below the support surface, at least one fastener channel that extends along the longitudinal axis below the support surface and is open through the mounting surface, and a downwardly open siding groove extending along the longitudinal axis. The cross-sectional configuration of the monolithic body may further define a fastener duct extending along the longitudinal axis underneath the upwardly facing support surface.

The disclosed ledger board substantially eliminates water penetration into the wall structure at the location of attachment, thereby preventing rot and structural failure.

BRIEF DESCRIPTION OF THE DRAWING VIEWS

The nature and mode of operation of the present disclosure will now be more fully described in the following detailed description taken with the accompanying drawing figures, in which.

DETAILED DESCRIPTION

Figure 1:
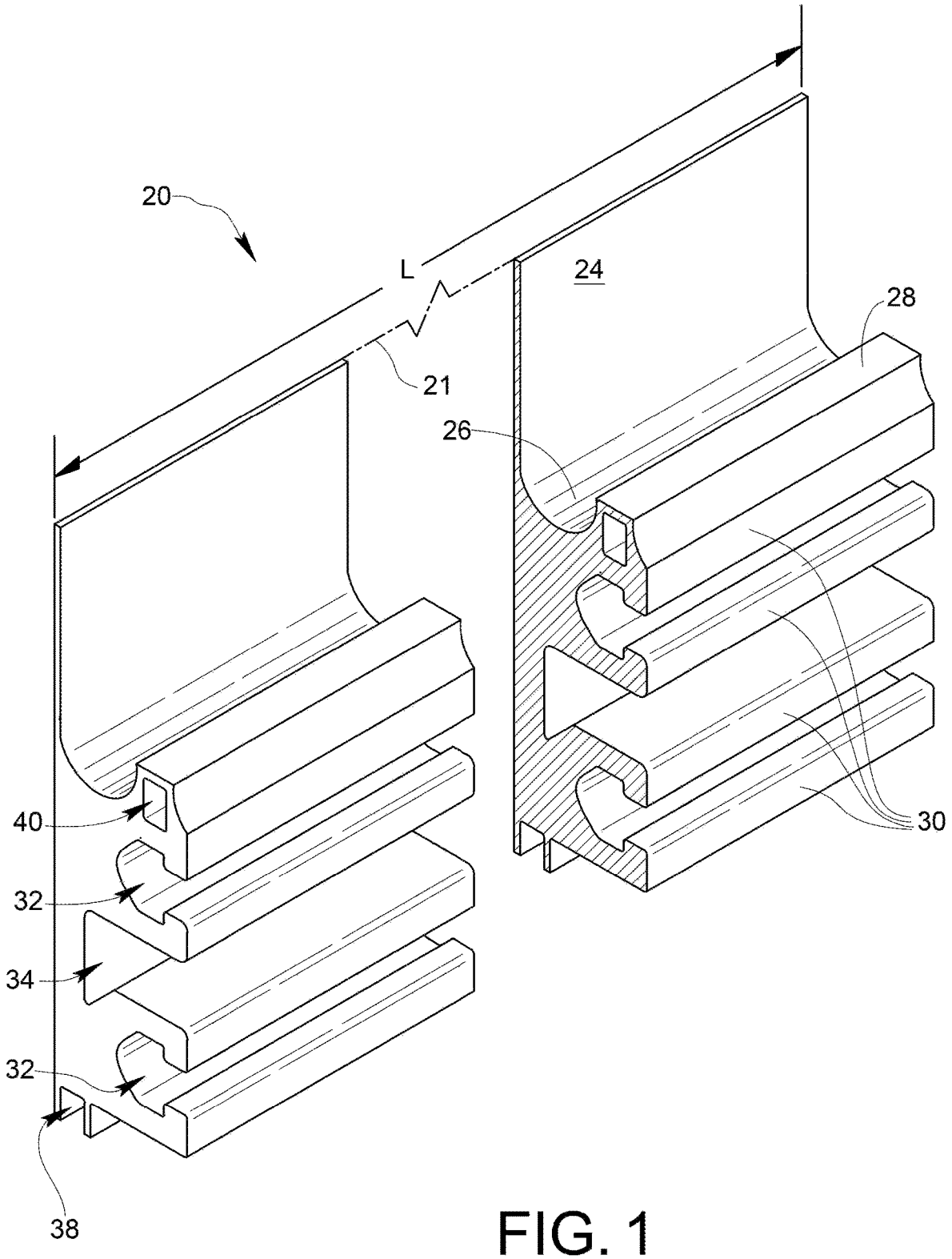
FIG. 1 is a perspective view of a ledger board formed in accordance with an embodiment of the present disclosure.
Figure 2:
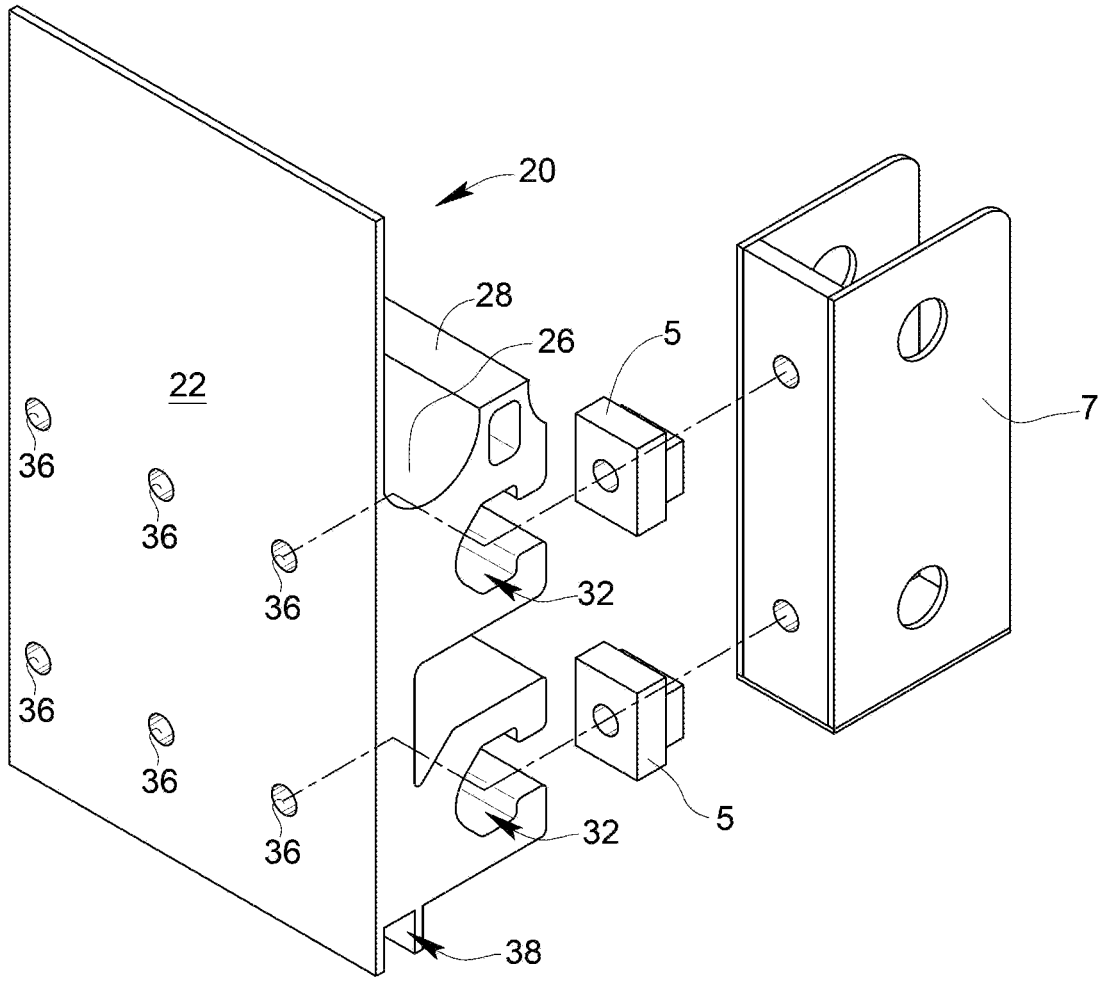
FIG. 2 is another perspective view of the ledger board shown in FIG. 1.
Figure 3:
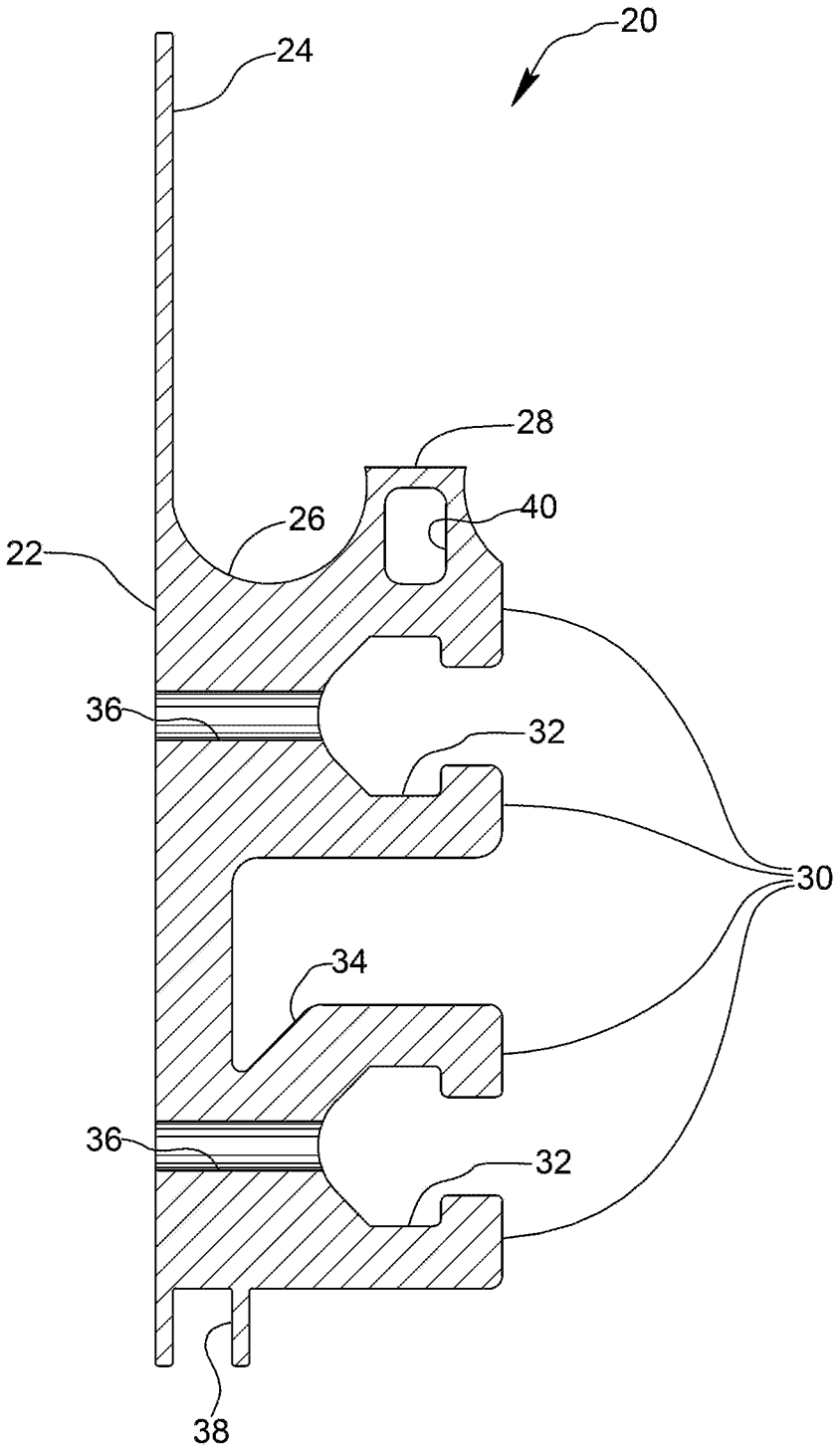
FIG. 3 is a cross-sectional view of the ledger board shown in FIG. 1.

FIGS. 1-3 show a ledger board 20 formed in accordance with an embodiment of the present disclosure. Ledger board 20 is designed for use in constructing a structural extension, such as a deck or stairs, on an existing structure, such as a residential home or commercial building.

Ledger board 20 has a monolithic (i.e., one-piece) body extending along a longitudinal axis 21. The monolithic body may be formed as a continuous extrusion, for example from plastic. The body of ledger board 20 may be formed to a desired length L, or cut to a desired length L, from a longer continuously extruded board. The monolithic body of ledger board 20 is attachable to one or more structural members of the existing structure for supporting the structural extension where the structural extension is connected to the existing structure.

FIG. 3 shows a sectional view of ledger board 20 as viewed along longitudinal axis 21, and thus depicts the cross-sectional profile of the monolithic body of the ledger board. As best seen in FIGS. 2 and 3, ledger board 20 includes an inner attachment surface 22 for engaging the existing structure.

As illustrated by the embodiment shown in the figures, the cross-sectional configuration of the monolithic body of ledger board 20 defines an upper flashing portion 24, an upwardly open gutter conduit 26 extending along longitudinal axis 21 below the flashing portion 24, an upwardly facing support surface 28 extending along longitudinal axis 21 above gutter conduit 26, and an outwardly facing mounting surface 30 extending along longitudinal axis 21 below support surface 28. As used herein, the terms "above" and "below" refer to a vertical position of one structure relative another structure, and do not require the structures to be in vertical alignment with each other (i.e., the structures may or may not be offset from one another in a horizontal direction).

The cross-sectional configuration of the monolithic body of ledger board 20 may further define at least one fastener channel 32 extending along longitudinal axis 21 below support surface 28, wherein the at least one fastener channel is open through the mounting surface. In accordance with the illustrated embodiment, the cross-sectional configuration may define a pair of fastener channels 32. The pair of fastener channels 32 may be separated from one another by an axially extending ventilation gap 34. The monolithic body of ledger board 20 may include a plurality of fastener holes 36 extending inwardly from each fastener channel 32 through attachment surface 22.

The cross-sectional configuration of the monolithic body of ledger board 20 may also define a downwardly open siding groove 38 extending along longitudinal axis 21 adjacent a bottom edge of attachment surface 22.

The cross-sectional configuration of the monolithic body of ledger board 20 may further define a fastener duct 40 extending along the longitudinal axis 21 underneath the upwardly facing support surface 28. As used herein, the term "underneath" refers to a structure which is directly below another structure (i.e., the structures are not offset from one another in a horizontal direction).

Figure 4:
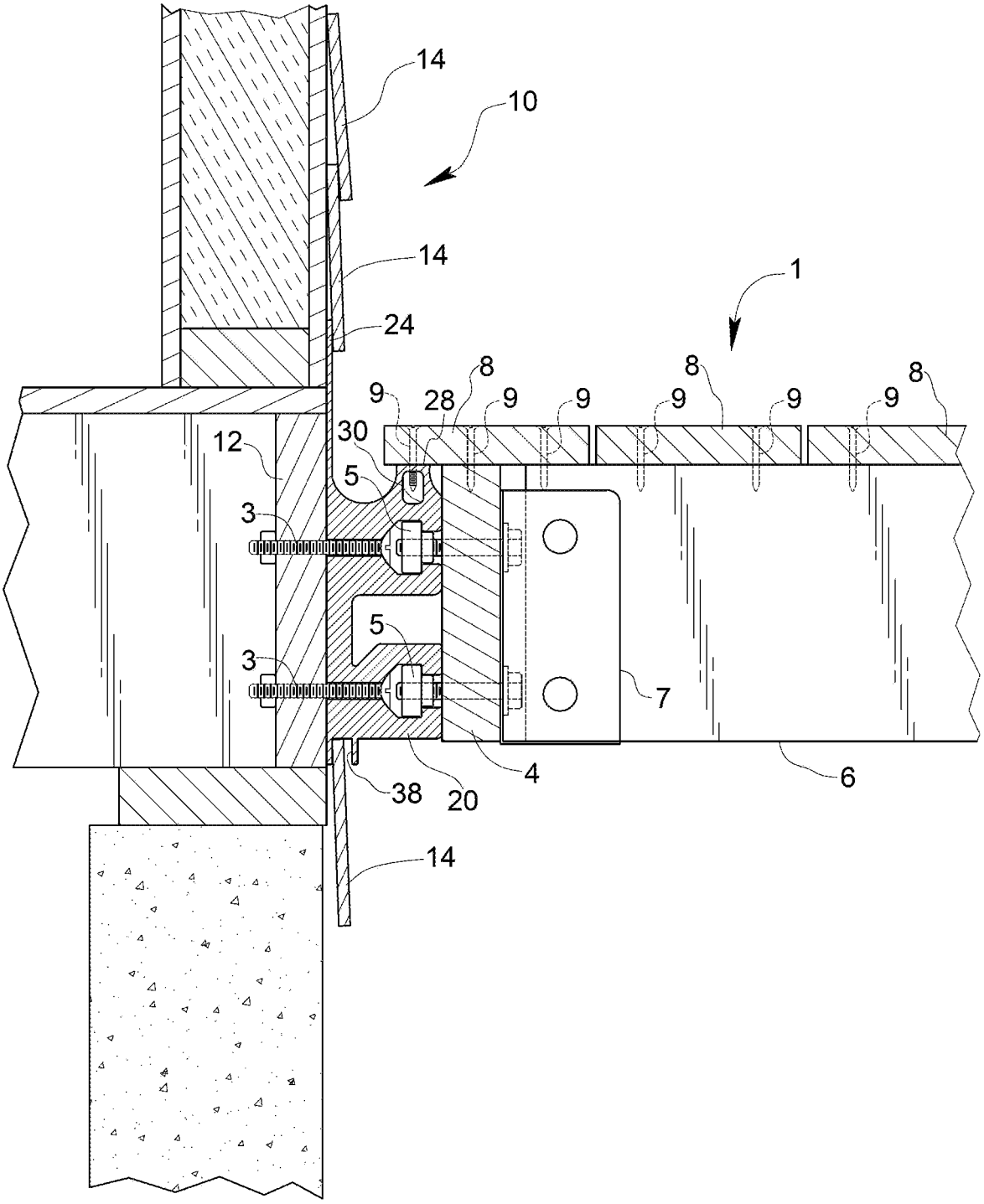
FIG. 4 is a cross-sectional view showing the ledger board of FIG. 1 installed to attach and support a deck on an existing structure according to a first arrangement.

FIG. 4 illustrates one arrangement for using ledger board 20 to attach a deck 1 to structural members 12 of an exterior wall 10. By way of non-limiting example, structural members 12 may be wall frame studs, concrete blocks, concrete foundation, bricks, or other structural members of an exterior wall of a residential home or commercial building. Ledger board 20 may be attached to exterior wall 10 by a plurality of fasteners 3. Fasteners 3 may be chosen based on the type of material and structure of the exterior wall at the location of attachment. For example, fasteners 3 may be wood screws, concrete or masonry screws, concrete or masonry anchors, pins, sleeve anchors, nuts and bolts, or any combination of the foregoing. Where exterior wall 10 includes siding 14, an upper region of flashing portion 24 may be arranged behind a row of siding 14, and another row of siding 14 may be arranged with its upper edge in siding groove 38. A rim joist 4 of deck 1 may be attached to ledger board 20 by a plurality of fasteners 5 positioned at intervals along each fastener channel 32. For example, fasteners 5 may be T-nut fasteners having a nut sized and configured such that the nut is confined and prevented from rotation by engagement with an inner wall surface of the corresponding fastener channel 32, and a bolt mating with the confined nut. A plurality of deck joists 6 may be attached by a plurality of joist hangers 7 to extend perpendicular to rim joist 4 (only one deck joist being visible in FIG. 4). An innermost decking plank 8 (i.e., a decking plank closest to the exterior wall 10) may be supported by upwardly facing support surface 28 of ledger board 20, rim joist 4, and deck joists 6. The innermost decking plank 8 may be attached to ledger board 20 by screws 9 extending though the decking plank 8 and preferably into fastener duct 40, whereby removal and replacement of rusted or damaged screws may be facilitated. Screws 9 may be self-tapping screws. Pilot holes may be drilled to assist installation of screws 9. Innermost decking plank 8 may be attached to rim joist 4 by additional screws 9. Finally, further decking planks 8 may be supported by deck joists 6 and attached thereto by screws 9.

Figure 5:
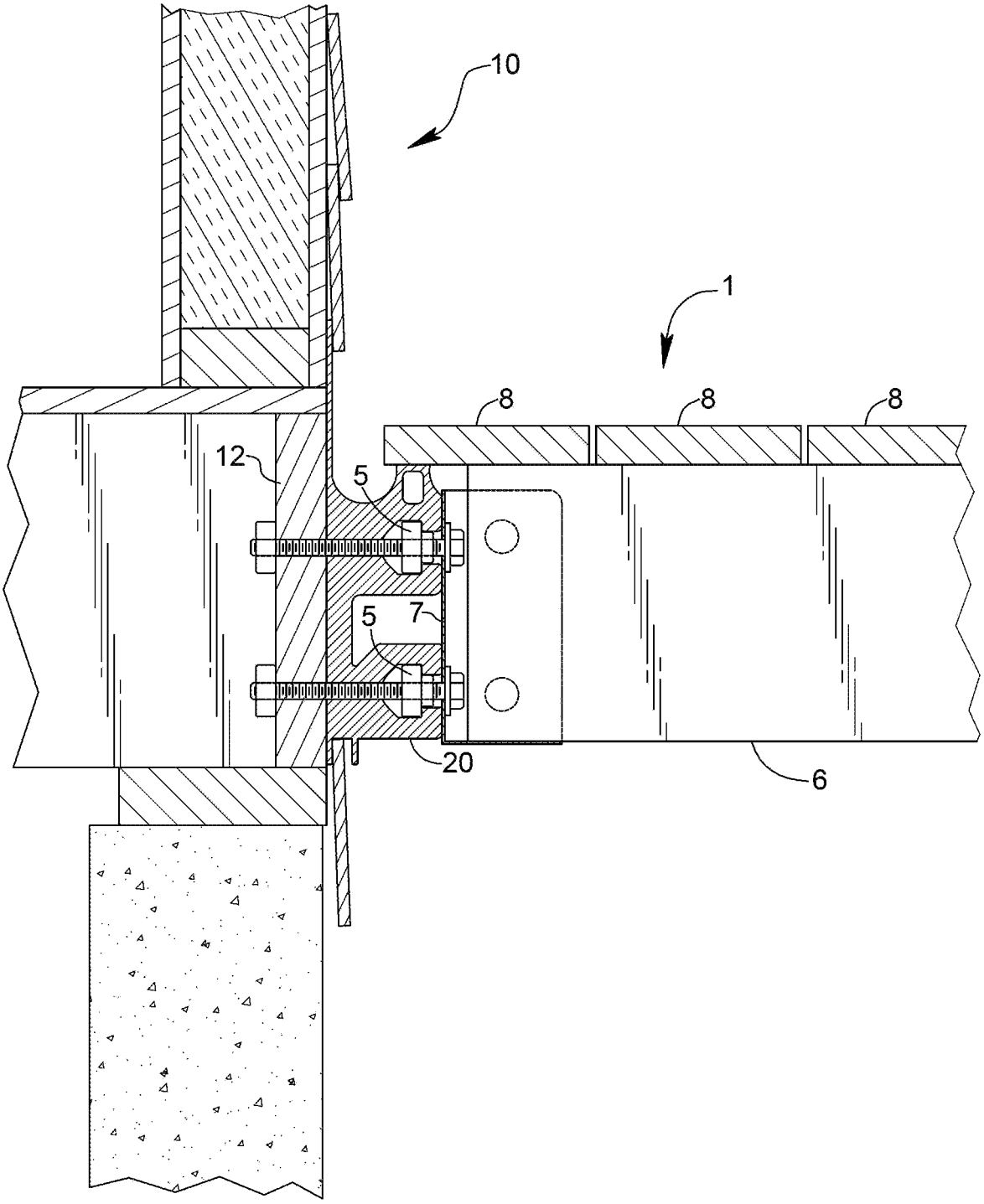
FIG. 5 is another cross-sectional view showing the ledger board of FIG. 1 installed to attach and support a deck on an existing structure according to second arrangement.

FIG. 5 illustrates another arrangement for using ledger board 20 to attach a deck 1 to structural members 12 of an exterior wall 10. In the arrangement shown in FIG. 5, deck rim joist 4 is omitted and joist hangers 7 are attached directly to ledger board 20 by fasteners 5. Fastener channels 32 may extend continuously along the entire length L of ledger board 20, thereby enabling joist hangers 7 to be positioned and attached at any selected locations along the length L of ledger board 20.

As may be understood, ledger board 20 of the present disclosure provides several important benefits. First and foremost, it substantially eliminates water penetration into the wall structure at the location of attachment of deck 1, thereby preventing rot and structural failure. As a result, deck 1 is safer and expensive repairs are avoided. Ledger board 20 is also easy to install and integrate with existing exterior wall structure, including siding 14, to form a liquid-sealed attachment location. Another benefit is that ledger board 10 facilitates replacement of rim joist 4, which can be unfastened from ledger board 10 by unscrewing the bolt portion of each T-nut fastener 5 from the nut portion of the T-nut fastener. Ledger board 20 may be scaled to different standard sizes and cut to different standard lengths, for example twelve-foot lengths and twenty-foot lengths.

While the present disclosure describes exemplary embodiments, the detailed description is not intended to limit the scope of the disclosure to the particular forms set forth. The disclosure is intended to cover such alternatives, modifications and equivalents of the described embodiments as may be apparent to one of ordinary skill in the art.

What is claimed is:

1. A ledger board for use in constructing a structural extension on an existing structure, the ledger board comprising:

a monolithic body extending along a longitudinal axis, the monolithic body being attachable to one or more structural members of the existing structure, wherein the monolithic body includes an inner attachment surface for engaging the existing structure and has a cross-sectional configuration defining:

an upper flashing portion having an outer surface;

an upwardly open gutter conduit extending along the longitudinal axis below the flashing portion;

an upwardly facing support surface extending along the longitudinal axis above the gutter conduit;

an outwardly facing mounting surface extending along the longitudinal axis below the support surface, wherein the mounting surface is an outermost surface of the ledger board and is a vertical surface;

at least one fastener channel extending along the longitudinal axis below the support surface, wherein the at least one fastener channel is open through the mounting surface; and a downwardly open siding groove extending along the longitudinal axis;

wherein the cross-sectional configuration of the monolithic body further defines a fastener duct extending along the longitudinal axis underneath the upwardly facing support surface.

2. The ledger board according to claim 1, wherein the at least one fastener channel includes a pair of the fastener channels.

3. The ledger board according to claim 2, wherein the cross-sectional configuration of the monolithic body defines a ventilation gap between the pair of the fastener channels.

4. The ledger board according to claim 1, wherein the monolithic body includes a plurality of fastener holes extending inwardly from the at least one fastener channel.

* * * * *